US005766530A

United States Patent [19]

Kalt et al.

[11] Patent Number: 5,766,530

[45] Date of Patent: Jun. 16, 1998

[54] PROCESS FOR THE PRODUCTION OF CELLULOSE MOULDED BODIES

[75] Inventors: Wolfram Kalt, Lenzing; Johann Männer, Weyregg; Arnold Nigsch, Ludesch; Heinrich Firgo, Vöcklabruck; Christian Hager, Seewalchen; Wolfgang Helmut Schkorwaga, Attersee, all of Austria

[73] Assignee: Lenzing Aktiengesellschaft, Austria

[21] Appl. No.: 471,842

[22] Filed: Jun. 6, 1995

[30] Foreign Application Priority Data

May 9, 1995 [AT] Austria ..... 783/95

[51] Int. Cl.[6] ..... B29C 47/00

[52] U.S. Cl. ..... 264/169; 138/145; 106/198; 106/203; 264/187

[58] Field of Search ..... 106/198, 203; 264/169, 37, 186, 187, 203; 138/145, 146

[56] References Cited

U.S. PATENT DOCUMENTS

| | | | |
|---|---|---|---|
| 4,246,221 | 1/1981 | McCorsley, III . | |
| 4,426,228 | 1/1984 | Bradner et al. | 264/187 |
| 5,189,152 | 2/1993 | Hinterholzer et al. | 106/198 |
| 5,216,144 | 6/1993 | Eichinger et al. | 106/203 |
| 5,354,371 | 10/1994 | Wykes et al. | 106/198 |
| 5,486,230 | 1/1996 | Kalt et al. | 106/203 |

FOREIGN PATENT DOCUMENTS

| | | |
|---|---|---|
| 399519 | 5/1995 | Austria . |
| 47929 | 9/1981 | European Pat. Off. . |
| 356419 | 8/1989 | European Pat. Off. . |
| 553070 | 1/1993 | European Pat. Off. . |
| 83-04415 | 6/1983 | WIPO . |
| 94-02408 | 2/1994 | WIPO . |
| 94-08162 | 4/1994 | WIPO . |
| 94-28210 | 12/1994 | WIPO . |
| 9508010 | 3/1995 | WIPO . |

OTHER PUBLICATIONS

International Search Report for WO 96/27035 (Feb. 12, 1996).

H. Firgo et al., "Kritische Fragen Zur Zukunft Der NMMO–Technologie" Lenzinger Berichte, pp. 87–89 and figs. 20–29 (Sep. 1994).

English language abstract of AT 399,519.

English language abstract of EP 47,929.

English language abstract of EP 356,419.

English language abstract of EP 553,070.

Buijtenhuis et al., "Papier 40", vol. 12, pp. 615–618(1986).

Kirk Othmer Encyclopedia of Chemical Technology ANSI Codes 420 and 304, 2d.ed., vol. 18, p. 789–(1969).

"Korrosion und Korrosionsschutz", Springer Verlag, p. 86 (1985).

*Primary Examiner*—Mathieu D. Vargot

*Attorney, Agent, or Firm*—Brumbaugh, Graves, Donohue & Raymond

[57] ABSTRACT

The invention is concerned with a process for the production of cellulose moulded bodies wherein a suspension of cellulose in an aqueous solution of a tertiary amine-oxide is transformed into a mouldable solution, said solution being extruded by means of a forming tool and conducted into a precipitation bath. The process is characterized in that at least part of the materials in devices and pipes for the transportation and processing of the solution, which material is in contact with the mouldable solution contains at a minimum of 90% up to a depth of at least 0.5 μm, preferably more than 1 μm, at least one element of the group consisting of titanium, zirconium, chromium and nickel in elementary form and/or in the form of compounds provided that the remaining of the material does not contain any of the elements of the group consisting of copper, molybdenum, tungsten or cobalt. By means of the use of certain elements and compounds according to the invention, it is possible to control the occurrence and the extent of exothermal degradation reactions in the cellulose solution.

8 Claims, No Drawings

PROCESS FOR THE PRODUCTION OF CELLULOSE MOULDED BODIES

BACKGROUND OF THE INVENTION

The invention is concerned with a process for the production of cellulose moulded bodies wherein a suspension of cellulose in an aqueous solution of a tertiary amine-oxide is transformed into a mouldable solution, which is extruded by means of a forming tool and conducted into a precipitation bath.

In recent decades, in view of the environmental problems caused by the known viscose process for the production of cellulose fibres, intensive efforts have been made to provide alternative, less polluting processes. In the last years, it has been found as a particularly interesting possibility to dissolve cellulose without derivatisation in an organic solvent and extrude moulded bodies from this solution. Fibres thus spun have received by BISFA (The International Bureau for the Standardization of man made fibers) the generic name Lyocell, an organic solvent being defined as a mixture of an organic chemical and water.

It has turned out that as an organic solvent, a mixture of a tertiary amine-oxide and water is particularly appropriate for the production of Lyocell fibres or other moulded bodies. As the amine-oxide, primarily N-methylmorpholine-N-oxide (NMMO) is used. Other appropriate amine-oxides are disclosed e.g. in EP-A-0 553 070. Processes for the production of cellulose moulded bodies from a solution of the cellulose in a mixture of NMMO and water are disclosed e.g. in U.S. Pat. No. 4,246,221. Fibres thus produced exhibit high fibre strength in conditioned as well as in wet state, high wet modulus and high loop strength.

A problem arising in the production of cellulose moulded bodies by means of dissolving cellulose in a mixture of NMMO and water consists in the stabilisation of the mouldable solutions thus obtained, since it has turned out that when dissolving cellulose in NMMO, a degradation of the cellulose occurs, which after prolonged thermal stress of the solution at temperatures exceeding 100° C. leads to an undesired decrease of the polymerisation degree of the cellulose as well as to the formation of low-molecule degradation products.

Additionally, amine-oxides, and particularly NMMO, have a limited thermal stability, which varies depending on their structure. The monohydrate of NMMO melts at temperatures of approximately 72° C., and the water-free compound melts at 172° C. When the monohydrate is heated, strong discolourings will occur from a temperature of 120°/130° C. on. Such temperatures however are common in processes for the production of cellulose moulded bodies. From 175° C. on, strong exothermal reactions will occur, which may lead to explosions. During this reaction, NMMO is thermally degraded, producing particularly N-methylmorpholine, morpholine, formaldehyde and $CO_2$.

Since the compounds being produced are substantially gaseous at the prevailing temperatures, the exothermal degradation of NMMO will produce high pressures which may cause damages in apparatus components.

It is known that the degradation of cellulose in solutions in NMMO and the thermal degradation of NMMO are clearly related. Up to now however, the actual mechanisms of these undesired phenomena have not yet been clarified.

The causes of the degradation phenomena, which sometimes occur spontaneously, have been repeatedly studied, and it particularly was found that metals in the mouldable solution seem to reduce the decomposition temperatures of the NMMO. Such results are cited in an article by BUIJTENHUIS et al., Papier 40 (1986) 12, 615–618, among other publications. It has been shown that primarily iron and copper accelerate the degradation of NMMO. According to this publication, also other metals such as nickel or chromium have a negative effect. It is believed that these effects are due to traces of metal ions produced by the metals.

Also, numerous proposals for the stabilisation of the mouldable solution of the cellulose in NMMO/water have been published. Most of these proposals, such as EP-A 0 047 929, PCT-WO 83/04415 or the Austrian Patent Application A 1857/93 deal with the addition of certain chemical substances to the process which slow down the degradation reactions of the cellulose as well as of the amine-oxide.

In EP-A 0 356 419, a process is presented, whereby a mouldable solution is obtained from a suspension of cellulose in an aqueous tertiary amine-oxide in one single step and in a continuous manner. Since this process is very fast, thermal degradation reactions occurring during the production of the solution can be minimized.

However, before being spun, the mouldable solution has to be transported through pipes or stored e.g. in buffer vessels to compensate differentials between the feeding of fresh solution and the consumption of the spinning device. Particulary at those sites of these pipes and devices wherein the mouldable solution comes to a standstill or is transported at a low rate, a high risk of degradation reactions arises.

In PCT-WO 94/02408 and in PCT-WO 94/08162 it is described that in the devices therein published stainless steel is employed, without giving more specifications.

PCT-WO 94/28210 describes the use of stainless steel having the AISI code 430 for a perforated plate of a spinneret and stainless steel according to AISI code 304 for the lateral walls of this spinneret.

In the literature "stainless steel" refers to iron based materials which by means of addition of other metals, particularly chromium, as well as e.g. molybdenum or nickel, exhibit a higher corrosion resistance. It is believed that this phenomenon is primarily due to the formation of protective oxide layers of the metals added which passivate the surface of the material. Thus the presence of the alloy components causes an additional passivation of the material surface, and simultaneously the corrosion of the basic metal iron, usually present in excess, is restrained to a certain extent.

The compositions of the common stainless steels are specified by various standards, such as the AISI codes of the American Iron and Steel Institute, which e.g. are indicated in KIRK-OTHMER, Encyclopedia of Chemical Technology, 2nd Edition (1969), Volume 18, pages 789 ff, or by the DIN standards listed in STAHLSCHLÜSSEL 1986 (Verlag Stahlschlüssel Wegst GmbH).

In studies carried out by the applicant, it has been found that inspite of the use of stainless steel, thermal degradation reactions of the cellulose and the amine-oxide cannot be prevented.

SUMMARY OF THE INVENTION

It is the object of the present invention to provide measures to minimize the above mentionend degradation reactions in the process for the production of cellulose moulded bodies from a solution of the cellulose in a mixture of a tertiary amine-oxide and water and to avoid the mentioned catalytic effects.

According to the invention, this object is attained in that at least part of the material of devices and pipes for the transportation and processing of the solution in contact with the mouldable solution contains at a minimum of 90% at least one element of the group consisting of titanium, zirconium, chromium and nickel in elementary form and/or in the form of compounds up to a depth of at least 0.5 μm, preferably more than 1 μm, measured from the surface, provided that the remaining of the material does not contain any of the elements of the group consisting of copper, molybdenum, tungsten or cobalt.

BRIEF DESCRIPTION OF THE PREFERRED EMBODIMENTS

The invention is based on the finding that at the surface of the materials in contact with the mouldable solution, degradation reactions catalyzed by the material itself may occur, and that it is therefor possible to provide material surfaces which when in contact with the mouldable solution do not present the above catalytic effects, thus neither inducing nor accelerating thermal degradation reactions.

Surprisingly it has been shown that using elements and/or compounds according to the composition according to the invention in device components in contact with the solution, thermal degradation reactions of the solution can be minimized, i.e. that degradation reactions in the mouldable solutions which wash the surfaces composed according to the invention do not occur substantially faster or stronger than in solutions not in contact with a technical material. In particular, compared to the materials known in the art, such as stainless steels according to the AISI codes 304 and 410, clearly better effects are obtained when employing the measures according to the invention.

Thus the elements and/or compounds employed according to the invention are not only corrosion resistant, so that substantially no introduction of metal traces or traces of metal ions into the mouldable solution will occur, but neither they exhibit the catalytic effects observed in conventional stainless steel. Therefore the elements and/or compounds employed according to the invention in components in contact with the solution subsequently will be referred to as substantially "non-catalytic", in order to distinguish them from other materials wherein catalytic effects can be observed.

Surprisingly it has turned out that only a relatively small number of elements and/or compounds of the known materials or material components shows the non-catalytic effects with regard to the solution. These elements surprisingly come from a variety of groups of the classification of chemical elements. It was found that elements coming from the same group of classification of elements exhibit completely different effects with regard to the stabilisation of the mouldable solution.

Thus e.g. chromium in elementary form or in the form of compounds or as an essential component of a material has turned out to be non-catalytic, while molybdenum being in the same group of classification of elements and known as an alloy component which increases the corrosion resistance significantly accelerates the occurrence of exothermal reactions when in contact with mouldable solutions.

The elements cobalt and tungsten for instance, which in other areas of the chemical process technique are often employed in elementary form or in the form of compounds, also exhibit very negative effects with regard to exothermal reactions.

In this regard it is also surprising that e.g. the elements chromium and nickel, to which the literature (BUJTENHUIS et al.) attributes a negative effect on the stability of the solution, give excellent results regarding the exothermal reactions in the process according to the invention, i.e., they evidently do not have any negative effect on the solution.

An important feature of the process according to the invention is that the elements and/or compounds employed according to the invention form a layer of at least 0.5 μm, preferably of more than 1 μm, at the surface of the materials in contact with the mouldable solution.

It is known from the art that many metals, when used as materials, form at their surface layers of their corresponding oxides, passivating the material with respect to a corrosive attack. As described above, such protective layers are formed e.g. also at the surface of stainless steel. These layers however, as described e.g. in "Korrosion und Korrosionsschutz", Springer Verlag 1985, p. 86, only have a thickness of a few molecular layers, e.g. in the range of 3–5 nm. When this extremly thin protective layer is broken at a site, a local element will form and thus a corrosive attack will occur, while simultaneously catalytically active materials will be contacted with the medium to an increased extent.

Due to the provision of the process according to the invention to employ the elements and/or compounds which substantially have turned out to be non-catalytic at a depth of at least 0.5 μm, drastically better effects with regard to avoiding thermal decomposition reactions could be attained compared to materials having a smaller thickness of their protective layer.

It is also important that the top layer provided according to the invention contains a maximum of only 10% of other elements exhibiting possibly catalytic effects. It is particularly advantageous when the layer consists practically completely of the non-catalytic elements, containing only traces of other elements, although material mixtures, consisting e.g. of only 90% of the non-catalytic elements, also have turned out to be appropriate in the process according to the invention. The elements copper, molybdenum, tungsten and cobalt however must never be present in such material mixtures.

It has proven advantageous when the layer provided according to the invention not only contains a non-catalytic element or compound, but mixtures of a non-catalytic element or its compounds as well as mixtures of various non-catalytic elements and their compounds.

Advantageously, the process according to the invention is provided in such a way that the materials in contact with the mouldable solution contain as the compounds of non-catalytic elements their oxides, carbides, nitrides, borides and/or silicides.

Particularly preferred compounds include the oxides of chromium, zirconium, titanium and nickel as well as chromium boride, chromium nitride, chromium carbide, titanium carbide and titanium nitride.

Another preferred embodiment of the invention is characterized in that the part of the materials in contact with the mouldable solution is arranged at least partly in layers, the top layer in contact with the solution containing at least one of the non-catalytic elements in elementary form and/or in the form of compounds at a minimum of 90%, and this layer being applied to a material which may also contain other elements and/or compounds of more than 10%.

It has turned out that even thin layers of the non-catalytic elements and/or compounds applied to materials having a negative effect on the solution reduce the risk of thermal decomposition reactions, provided that the thickness of the layer exceeds 0.5 μm. This embodiment of the process according to the invention contributes to make the process economical, since smaller amounts of the non-catalytic elements and/or compounds, which in part are relatively expensive, are required and more economical materials, e.g. stainless steel, may be employed as basis materials for coating.

Another advantageous embodiment of the invention is characterized in that the materials in contact with the solution contain the at least one non-catalytic element with a depth of at least 0.5 μm in those device components and pipes wherein the mouldable solution comes to a standstill or moves on only at a slow rate.

Particular danger spots in the process for the production of moulded bodies from solutions of cellulose in tertiary amine-oxides are the so-called "clearance volumes", i.e. those sites wherein there is no or substantially no movement of the mouldable solution. At these sites, e.g. at filtration devices or shut-off devices such as stop-cocks and the like, the solution exhibits high residence times at an elevated temperature, implying naturally a higher risk of thermal decomposition reactions.

It has been shown that the occurrence of thermal decomposition reactions may be reduced already to a great extent when only at these sites layers of the non-catalytic elements and/or compounds are used. Thus it is possible to employ the non-catalytic substances in a particularly economical way.

Further, the object of the present invention is attained by using at least one element of the group consisting of titanium, zirconium, chromium and nickel in elementary form and/or in the form of compounds in materials of devices and pipes in contact with a mouldable solution of cellulose in a mixture of a tertiary amine-oxide and water at a percentage of at least 90% up to a depth of at least 0.5 μm, preferably more than 1 μm.

The invention will be explained in more detail by means of the following Examples, using mouldable solutions having a cellulose content of approximately 15% to compare the influence of different substances on inducing thermal decomposition reactions.

1) Sample preparation

Mouldable cellulose solutions of the cellulose in aqueous N-methyl-morpholine-N-oxide (NMMO) produced according to the process described in EP-A 0 356 419 containing 15% of cellulose and 500 ppm of gallic acid propyl ester (GPE) and 500 ppm of hydroxylamine each (based on the cellulose) as stabilizers were fine-ground in solid, crystallized state in a laboratory mill.

Before starting each of the tests, the corresponding pulverized metals and/or metal compounds were distributed homogeneously in the ground cellulose solutions, employing in each case a constant volume of metal additives to obtain homogeneous surfaces (calculation of the mass by means of the density).

In the tests carried out in a SIKAREX® furnace, the addition of pulverized metals and/or metal compounds was 0.035 $cm^3$ of powder to 11.5 g of cellulose solution and in the gaschromatographic tests $7.5*10^{-4}$ $cm^3$ of powder to 200 mg of cellulose solution.

A solution produced without any addition of metals and/or metal compounds, but otherwise in the same way, was used as a Comparative Sample to determine a blank value (BV).

2) Analytical methods:

a) Performing the safety calorimetric test in the SIKAREX ® furnace:

The tests were carried out in a SIKAREX ® furnace (TSC 512) of the company SYSTAG, the samples being heated in a closed pressure vessel having a glass insert.

As a temperature program, a step-experiment of Standard Software was operated wherein very slow heating (heating rate of 6° C./h) between two isothermal steps (1. step 90° C., 2. step 180° C.) was carried out, resulting in the area of interest in a dynamic operation providing excellent reproducibility with regard to the exothermal phenomena. During the heating, the difference between the temperature of the heating jacket (TM) and the temperature of the sample (TR) was continuously measured. The registered data were processed by computer.

b) Performing the gaschromatographic tests:

The samples filled into so-called vials were exposed to thermal stress of 120° C. in a headspacesampler (HP 7694) for a time period of 5 hours. The first analysis was carried out after 15 min. Afterwards, analysis was carried out at hourly intervals.

In each analysis, the vial was impacted with an over pressure of 150 kPa of He, afterwards being released to normal pressure by switching a valve in a loop present in the sampler. After an equilibration phase and another switch of the valve, the gaseous products were incorporated into a carrier gas stream of He carrying the gas phase to an injector for a gas chromatograph across a transfer line. After splitting the carrier gas stream in a 1:70 ratio it was injected into a column (Stabilwax DB+phenylmethylsilicone deact. Guard Column, length 30 m; i.D. [mm]: 0.32; film [μm]: 0.5) and a temperature program was operated. Detection was carried out by means of an FID detector.

In the hourly analysis, the produced amount of N-methylmorpholine (NMM), which is one of the essential decomposition products of an NMMO solution, was measured.

3) Results

The two measuring methods give characteristic parameters:

Tests in the SIKAREX ® furnace:

TM at Δ10 . . . is the jacket (furnace) temperature at which due to an exothermal process the temperature is 10° C. higher in the sample than in the jacket.

Gaschromatographic tests:

[NMM]norm . . . indicates the formation of amine standardized to a blank value (BV) of the sample, whereto an additive (powder of metals or metal compounds) has been mixed. A value of 2 means e.g. the twice formation of amine compared to the blank value.

These parameters clearly reveal common trends in the tests. Thus, degradation tests giving high stability values in the SIKAREX test (e.g. high TM at Δ10) usually show simultaneously a very reduced formation of amines. On the contrary, when stability values decrease, usually a significant increase in amine formation is observed.

Due to the common trends observed in the results, it is possible to classify parameters in combined safety parameters which reflect still more clearly the influence of materials (additives) on dope.

For the following description, the following safety parameter Sk2 (10) was defined and shown in the Tables:

$$Sk2(10) = \frac{(TM \text{ at } \Delta 10)}{[NMM]norm}$$

The Sk2 (10) value clearly indicates the safety criteria of a material (or its catalytic activity) in the NMMO process, since it reflects the temperature behaviour (at what point an exothermal reaction will occur) and the trend of formation of the most important degradation product NMM, which is relevant for nearly all degradation reactions initiated by metals.

The higher the Sk value, the more reduced and thus the more positive is the influence of a material on the medium. It has to be taken into account however that it only makes sense to compare Sk values of different materials when the grain sizes of the corresponding materials and therefore their corresponding specific surfaces are as homogeneous as possible.

In the following Tables, the different samples measured will be compared by means of the determined Sk2 (10) value, their particle size being indicated:

TABLE 1

Addition of commercially available metal powder to cellulose solutions:

| Additive | Particle size | Sk2(10) |
|---|---|---|
| - (blank value "BV") | — | 160,80 |
| Titanium | <149 μm | 160,40 |
| Chromium | <149 μm | 157,55 |
| Nickel | <149 μm | 128,49 |
| Cobalt | <149 μm | 62,74 |
| Iron | <149 μm | 50,44 |
| Tungsten | <149 μm | 29,71 |
| Molybdenum | <149 μm | 5,37 |
| Ruthenium | <74 μm | 12,29 |

TABLE 2

Addition of element compounds in pulverized form:

| Additive | Particle size | Sk2(10) |
|---|---|---|
| - (blank value "BV") | — | 160,80 |
| Titanium nitride | <10 μm | 161,72 |
| Chromium carbide | <44 μm | 149,14 |
| Chromium oxide | ~1 μm | 130,25 |
| Chromium nitride | <44 μm | 118,80 |
| Chromium boride | <44 μm | 105,21 |
| Tungsten carbide | <10 μm | 60,16 |
| Iron sulphide | <149 μm | 52,56 |
| Molybdenum carbide | <44 μm | 29,30 |
| Tungsten sulfide | <2 μm | 24,83 |
| Molybdenum sulfide | <1 μm | 14,43 |

From Table 1 and 2 it can be deduced clearly that the elements used according to the invention in elementary form as well as in the form of compounds show a significantly more positive influence regarding decomposition reactions than e.g. the elements iron, molybdenum, ruthenium and tungsten.

In the elements used according to the invention, the Sk2 (10) values significantly exceed 100, while in catalytically active materials they are clearly below 100. Particularly when titanium or titanium compounds are used, exothermal reactions will start as late and at the same intensity as in a solution whereto no materials at all have been added.

It should be mentioned that the metal compounds indicated in Table 2 do not have uniform particle sizes, as can be seen. Therefore, an absolute comparison of the Sk2 (10) values is not possible, but from Table 2 the trend is evident that the titanium and chromium compounds used according to the invention, even having the most varied particle sizes, give significantly better values than other metal compounds.

The following Table shows the influence of the use of materials having catalytic effects themselves which have been coated with non-catalytic substances. In these tests, shims of different basis materials were measured. In each of the coatings, the thickness of the layer was at least 2 μm.

TABLE 3

Addition of coated/not coated shims:

| Basic material | Coating | Sk2(10) |
|---|---|---|
| - (blank value "BV") | — | 160,80 |
| Structural steel | Nickel | 144,46 |
| Structural steel | Chromium | 141,49 |
| Structural steel | NiCr + $ZrO_2$ | 110,62 |
| Stainless steel 1.4571 | — | 72,56 |
| Structural steel | — | 37,82 |

Also from this Table, the positive influence of the elements nickel, chromium and zirconium can be seen. The Sk2 (10) value of the coating with NiCr and zirconium oxide, which compared to nickel and chromium slightly decreases, is due to a deficient coating of the sample.

Thus it is possible to control the occurrence and the extent of exothermal reactions in solutions of cellulose in aqueous amine-oxides in a particularly economical way by coating cheaper materials such as structural steel with the materials used according to the invention.

We claim:

1. A process for the production of a cellulose molded body comprising the steps of:

transforming a suspension of cellulose in an aqueous solution of tertiary amine-oxide into a moldable solution;

extruding the solution using a forming tool; and conducting the solution into a precipitation bath through a conducting means wherein the surface of a portion of the conducting means contacting the solution comprises a top layer having a thickness of at least 0.5 μm, at least 90% of the top layer comprising a non-catalytic substance selected from the group consisting of elemental titanium, elemental zirconium, elemental chromium, elemental nickel, a titanium compound, a zirconium compound, a chromium compound, a nickel compound and combinations thereof, wherein the remainder of the top layer is free of copper, molybdenum, tungsten or cobalt.

2. A process according to claim 1, wherein the top layer has a thickness of at least 1.0 μm.

3. A process according to claim 2, wherein the titanium compound, the zirconium compound, the chromium compound and the nickel compound are selected from the group consisting of oxides, carbides, nitrides, borides and silicides.

4. A process according to claim 1, claim 2 or claim 3, wherein the top layer overlays material comprising less than 90% of a non-catalytic substance selected from the group consisting of elemental titanium, elemental zirconium, elemental chromium, elemental nickel, a titanium compound, a zirconium compound, a chromium compound, a nickel compound and combinations thereof.

5. A conducting means for transporting a moldable solution of cellulose in a mixture of tertiary amine oxide and water, wherein the surface of a portion of the conducting means contacting the solution comprises a top layer having a thickness of at least 0.5 μm, at least 90% of the top layer comprising a non-catalytic substance selected from the group consisting of elemental titanium, elemental zirconium, elemental chromium, elemental nickel, a titanium compound, a zirconium compound, a nickel compound and combinations thereof, wherein the titanium compound, the zirconium compound, the chromium compound and the nickel compound are free of copper, molybdenum, tungsten or cobalt.

6. A conducting means as in claim 5, wherein the top layer has a thickness of at least 1.0 μm.

7. A conducting means as in claim 6, wherein the titanium compound, the zirconium compound and nickel compound are selected from the group consisting of oxides, carbides, nitrides, borides and silicides.

8. A conducting means as in claim 5, claim 6 or claim 7, wherein the top layer overlays material comprising less than 90% of a non-catalytic substance selected from the group consisting of elemental titanium, elemental zirconium, elemental chromium, elemental nickel, a titanium compound, a zirconium compound, a chromium compound, a nickel compound and combinations thereof, wherein the titanium compound, the zirconium compound, the chromium compound and the nickel compound are free of copper, molybdenum, tungsten or cobalt.

* * * * *